US005158293A

United States Patent [19]

Mullins

[11] Patent Number: 5,158,293

[45] Date of Patent: Oct. 27, 1992

[54] LOTTERY GAME AND METHOD FOR PLAYING SAME

[76] Inventor: Wayne L. Mullins, 11811 N. Tatum Blvd., #3031, Phoenix, Ariz. 85028

[21] Appl. No.: 767,055

[22] Filed: Sep. 27, 1991

[51] Int. Cl.[5] ..... A63F 3/06; B42D 15/00

[52] U.S. Cl. ..... 273/139; 283/903; 283/901; 283/102

[58] Field of Search ..... 273/139, 138 R; 283/100-102, 901, 903

[56] References Cited

U.S. PATENT DOCUMENTS

| | | | |
|---|---|---|---|
| 4,591,190 | 5/1986 | Clark | 283/102 |
| 4,634,149 | 1/1987 | Donovan | 283/102 |
| 4,953,895 | 9/1990 | Goussios | 283/102 |
| 5,046,737 | 9/1991 | Fienberg | 273/139 |

FOREIGN PATENT DOCUMENTS

| | | | |
|---|---|---|---|
| 155462 | 11/1979 | United Kingdom | 273/139 |
| 2085308 | 4/1982 | United Kingdom | 273/139 |

*Primary Examiner*—Benjamin H. Layno

*Attorney, Agent, or Firm*—Rosenbaum & Schwartz

[57] ABSTRACT

A lottery game and a method for playing a lottery game which incorporates an instant play type lottery game combined with a jackpot type lottery game and also incorporates a second bonus jackpot type drawing where only selected tickets from the original lottery jackpot drawing are eligible to win and where the method of determining those tickets eligible in the bonus jackpot drawing is related to the results of the instant lottery game.

24 Claims, 3 Drawing Sheets

LOTTERY GAME AND METHOD FOR PLAYING SAME

BACKGROUND OF THE INVENTION

This invention relates to the field of games, and specifically to lottery type games.

Lottery games are well known as are similar games such as bingo and keno. These games are often played for entertainment purposes. These games are often run by government agencies in order to raise revenue. They are most often games of chance where the player purchases a ticket valid for one or more plays of the game often with an opportunity to win a pool of money or some other valuable prize.

Lottery games are typically divided into two common types of games: one being played with an instant game ticket and the other being a "lottery jackpot ticket." A lottery jackpot ticket is often refered to as a "Lotto Ticket". The instant ticket lottery game is often described as a "scratch ticket." A scratch ticket often involves the use of a printed ticket containing indicators covered with a removable coating. The player purchases a ticket and removes the removable coating to reveal the hidden indicators. Tickets containing specified indicators are winning tickets, while tickets with any other indicators are losing tickets. A winning ticket entitles the ticket holder to claim a certain prize, usually a fixed monetary award which is often specified on the ticket. Examples of instant win lottery games are shown in Great Britain Patent No. 1,555,462 issued to Rocklin, U.S. Pat. No. 4,634,149 issued to Donovan, and Great Britain Patent Application No. 2085308 issued to Edwards.

The jackpot type lottery game is usually played with the player purchasing a ticket containing at least one number series. The numbers are either assigned randomly or selected by the player. All numbers played must be selected from a specified field or set of numbers, for example from the numbers 1 to 42. On a certain date lottery officials a selection of numbers from the field and any ticket bearing the selected numbers is a winner of a valuable prize, usually money referred to as the jackpot. In many variations of the game the jackpot pool is a percentage of the total jackpot ticket sales revenue. U.S. Pat. No. 4,591,190 issued to Clark shows a voucher that can be used for such a lottery drawing and the Edwards patent referred to above also shows such a lottery game.

One of the problems with many of the lottery games already known is that they allow the player only one play for each ticket purchased. Attempts have been made to combine two games onto one lottery ticket as shown by the Edwards patent application, but these have not been widely adopted. A further problem with lottery games is that a jackpot type of ticket draws a players attention for only one jackpot drawing and there is no lottery game that which combines attributes of both a scratch ticket and a jackpot type of ticket.

SUMMARY OF THE PRESENT INVENTION

An object of the present invention is to provide a game ticket that combines elements of both a scratch ticket and a jackpot type ticket.

A further object of the game is to give a lottery player the option to participate in both a scratch game and a jackpot game while purchasing one lottery ticket.

A further object of the game is to provide a lottery game that provides for a jackpot type game that gives a lottery player a play for a jackpot type drawing and a possible play for a bonus jackpot drawing based on the outcome of his instant play ticket.

The present invention allows a player for the purchase of one ticket to play a scratch ticket, a jackpot ticket and possibly a second jackpot drawing based upon the results of scratch ticket.

DESCRIPTION OF THE PREFERRED EMBODIMENT

Figure 1:
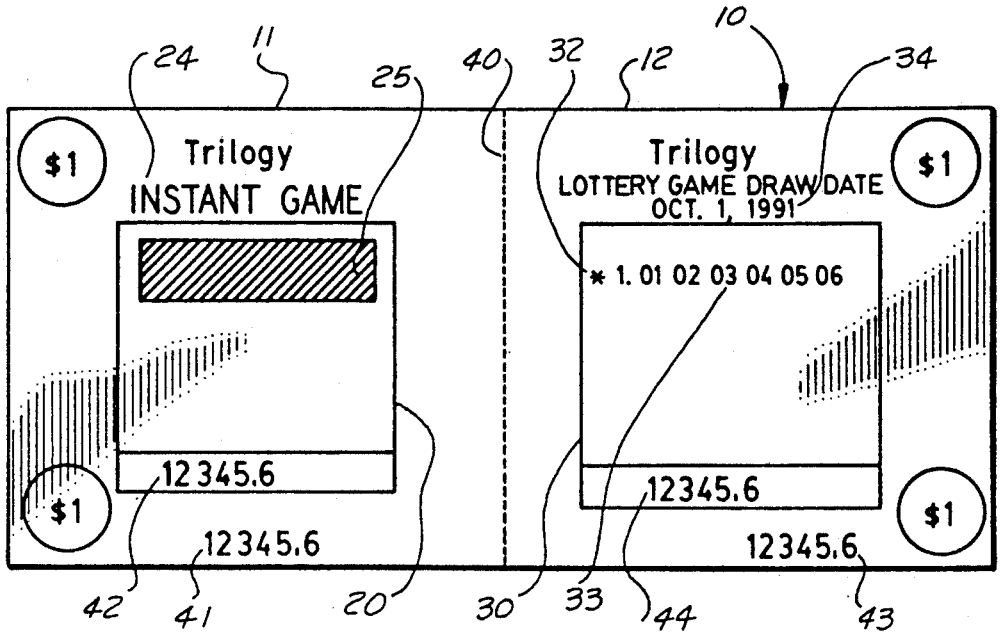
FIG. 1 is a plan view of a lottery ticket which can be used in one embodiment of the game.

Referring to FIG. 1, in one embodiment of this game a preprinted lottery ticket 10 is sold to a player. This ticket is perforated at perforation 40, which divides the ticket into two halves 11 and 12. The two halves correspond to one-half ticket for playing the instant game 11 and the other half ticket for playing the lottery jackpot game 12. Notwithstanding this illustrated embodiment, game tickets of the present invention can comprise more than two portions separable by multiple perforations across the ticket, with each portion of the ticket comprising a separate lottery game. Further, the game could be played with multiple tickets that are related to each other.

Figure 3:
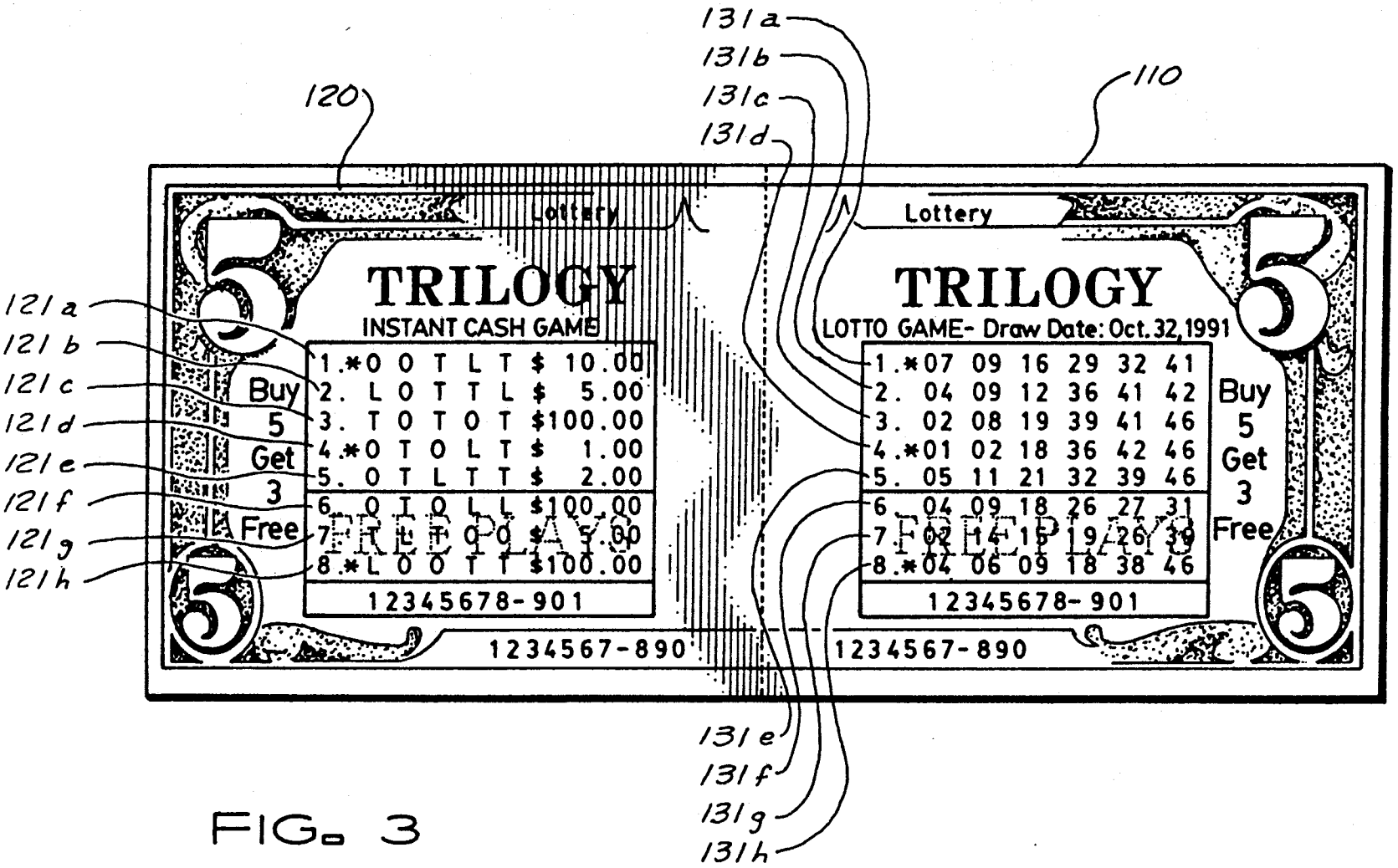
FIG. 3 is a plan view of an embodiment of a multiple play lottery ticket of the present invention.

The lottery ticket may be purchased in various monetary denominations with either a single play being purchased or with multiple plays. Lottery ticket 10 is a lottery ticket of the current invention for a ticket in a one dollar denomination which is purchased for one play of the lottery game of the current invention. Referring to FIG. 3, lottery ticket 110 is a $5.00 ticket which entitles the player to multiple plays of the game of the present invention, in its first embodiment. Lottery ticket 110, is a $5.00 denomination which entitles the player to 8 plays.

Figure 2:
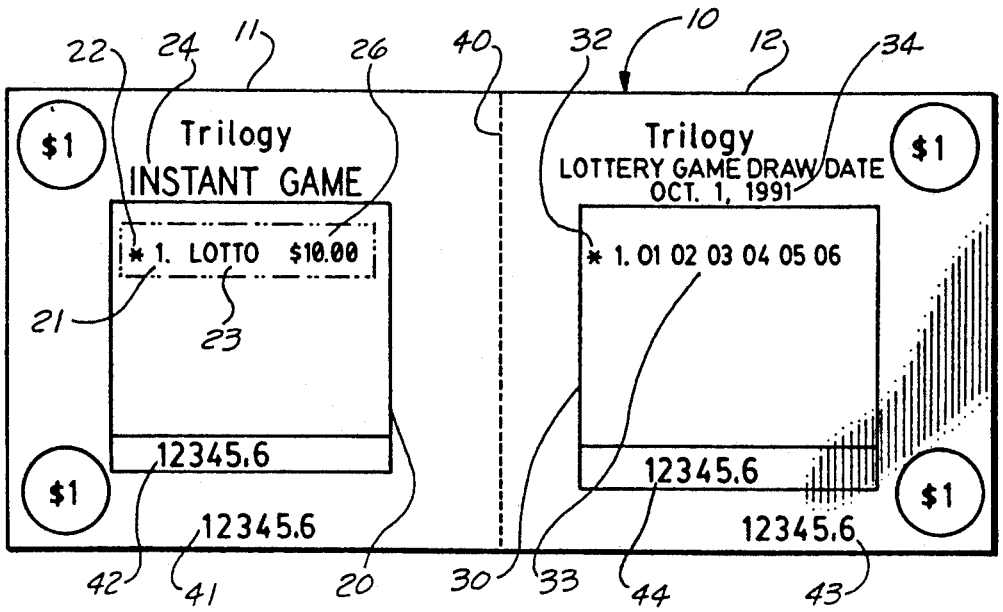
FIG. 2 is a plan view of the lottery ticket of FIG. 1, illustrating removal of a portion of the ticket.

Referring again to FIG. 1, half-ticket 11 bears an indication 24 that this half-ticket is the instant game portion of the ticket. The playing area is delineated by being set forth in box 20. The instant play has a hidden indicator 23 covered by removable material 25. FIG. 2 shows the same lottery ticket 10 after the removable material 25 has been has been abraded away and the indicator 23 is revealed. Also, inside box 20 is a number 21 indicating that this ticket has only one play. The covering 25 may be made of any known material that can be easily removed by scratching or abrading.

The instant game half-ticket may incorporate any type of known instant lottery game.

In one embodiment the instant game is played by the hidden indicator 23 being a series of letters being printed on the ticket. A winning combination of letters would be any combination of letters which spell the word "LOTTO." Other instant play games are known in the art and could be substituted. Examples of other instant play games include hidden indicators which include a series of symbols such as bells, cherries, oranges etc. with a winning combination being a specified series of the same symbols such as 3 bells, 3 cherries or 3 oranges; a series of numbers whose total matches a specified number; or a depiction of playing cards with a winning combination being a winning poker hand or a winning blackjack hand. For ease in determining a winning instant game an additional indicator 22, in this case an asterisk, is placed beside the winning series of indicators.

In the example shown a winning instant game wins the instant monetary prize identified with the winning series of indicators 23 on the half-ticket 11. With particular reference to the game shown in FIG. 2, game play 21 which comprises indicator 23 is a winning hand entitling the player to redeem prize 26, $10.00.

It is also well known in the art that instant win lottery tickets often have the playing surfaces covered with a removable material which conceal the game until the time the player wishes to play the game. It is common for the playing area to be covered with a material that can easily be removed by rubbing the playing area with an abrasive material such as the edge of a coin. In FIG. 2 this removable material has been removed and the instant game play has been revealed. The area where the covering was removed is shown in phantom in FIG. 2.

After play of the instant game, the player with a winning instant ticket would redeem his prize 26 from lottery officials or from the lottery ticket vendor by turning in the instant portion of the lottery ticket 11. In this embodiment of the game the instant win prizes 26 are shown on the winning ticket itself. In other embodiments of the game it is not necessary for the prizes to be stated on the ticket and the prizes could be otherwise publicized. Further, it is not necessary to award monetary prizes. Any type of prize which the players deem valuable or worthwhile could be used.

The instant half-ticket 11 can be verified by several known verification methods. A common verification mechanism is to have an identification number 42 printed on the ticket. Often a second verification number 41 which corresponds or is related to the first number is also printed on the ticket. In many versions of known lottery tickets these second verification numbers are printed and concealed on the tickets. It is important for reasons that will be explained later that the jackpot half-ticket 12 contain corresponding or duplicate verifications numbers, 43 and 44. In order for the player to be able to immediately redeem his instant prize while still being able to maintain a lottery half-ticket for the jackpot draw it is important the ticket be separable into it two separate parts. This is allowed by perforation 40.

The second part of the lottery game is a known jackpot lottery drawing. The second half of the ticket 12 defines the date lottery jackpot drawing will be held 34. The player has been randomly assigned a series of numbers 33 selected from a field of numbers from which the winning numbers will be drawn. It is typical of these type of lottery games to have a randomly selected series of numbers drawn from a selected field of numbers, for example to draw 6 numbers from the field of numbers from 1 to 42. The random selection of winning numbers is assured by lottery officials. On the specified drawing date the lottery officials randomly select a series of numbers from the field and this series of numbers becomes the winning numbers. Any playing ticket bearing the winning numbers is a winning ticket. The holder of a winning ticket is then entitled to the lottery prize, often called the jackpot. The jackpot is often a pool of money formed by placing a portion of the purchase price of each lottery ticket sold into the lottery jackpot pool. However, the jackpot could comprise any valuable prize.

One known method to assure a random selection of winning numbers by lottery officials is to place the numbers on identically weighted balls which are circulated and randomly drawn from a hopper. Any known method of ensuring a random drawing of the winning numbers could be used. It is important that the selection of winning numbers be random so that the odds of winning the jackpot are known to the lottery players. Similarly, other sets of indicators could be used in place of numbers, including letters or other symbols, provided that they are can be selected from a known field.

Again a winning ticket would be verified by lottery official by use a verification mechanism such as the verification numbers printed on the second half lottery ticket at 43 and 44. Other types of verification means for winning tickets are known and could be used.

In addition to the combined instant game and jackpot ticket embodied in lottery ticket 10, the player of this ticket may also be eligible for entry in yet another lottery game, the bonus lottery. The player would be eligible to play any series of numbers on the jackpot half of the ticket that correspond to a winning series on the instant-win half of the ticket in the bonus game. The bonus drawing would be held subsequent to the initial jackpot drawing date indicated at 34.

Indicator 32 shows that series 33 is eligible for play in the bonus lottery. If instant play 23 was not a winning combination, indicator 22 would not be present on half-ticket and corresponding indicator 32 would not be present on half-ticket 12. The verification means 41 and 42 on half-ticket 11, are correlated to verification means 43 and 44 on half-ticket 12 so that lottery officials will have a means to verify that half-ticket 12 is eligible for bonus lottery play. Lottery officials could require that the player redeem instant play half-ticket 11 prior to a player redeeming winning bonus half-ticket 12, in order to verify its eligibility for the bonus jackpot prize.

The bonus jackpot award could be a second monetary award or could be some other type of valuable prize. In addition further variations are also available with supplementary bonus draws being held on a periodic basis, such as all bonus tickets being eligible for a daily, weekly, monthly and yearly drawing.

FIG. 3 shows yet another embodiment of the present invention comprising a multiple play lottery ticket 110 which would be eligible for play in the same lottery game as lottery ticket 10. The instant plays are shown in box 120 and each play is sequentially numbered 121*a–h*. As in the embodiment discussed previously, each instant play corresponds to a jackpot play, which is correspondingly sequentially numbered 131*a–h*, and each game play entitles the player to one instant play, one jackpot play, and potentially one bonus play. Lottery ticket 110 shows a denomination of $5 and gives the player 8 individual plays in the lottery. In its other respects, this embodiment of the invention is substantially the same as that described previously.

Figure 4:
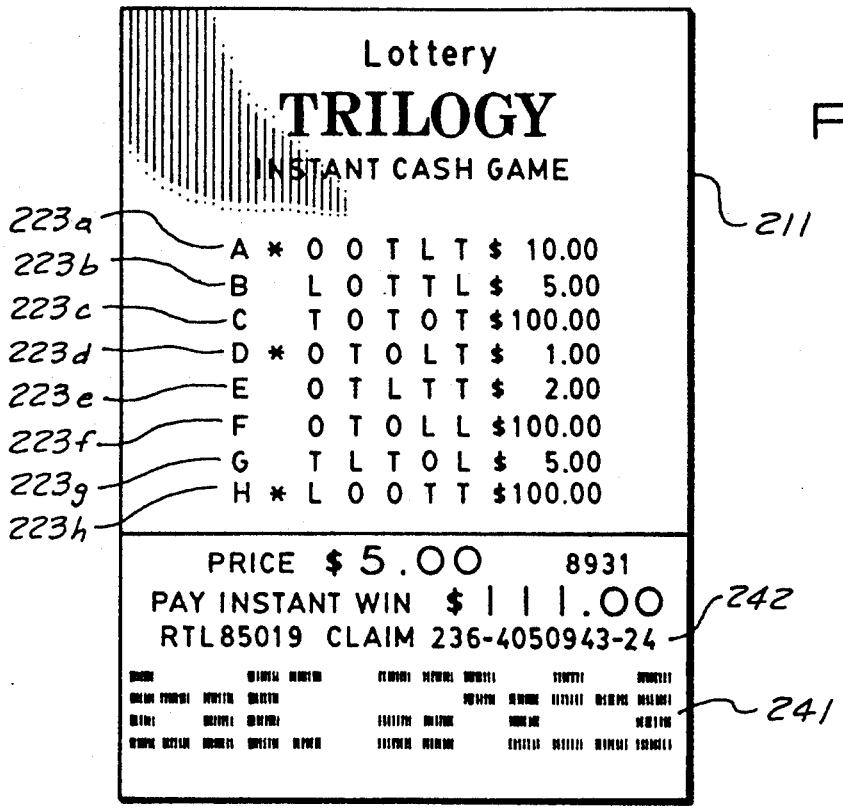
FIG. 4 is a plan view of an on-line generated instant lottery ticket used in a second embodiment of the invention.
Figure 5:
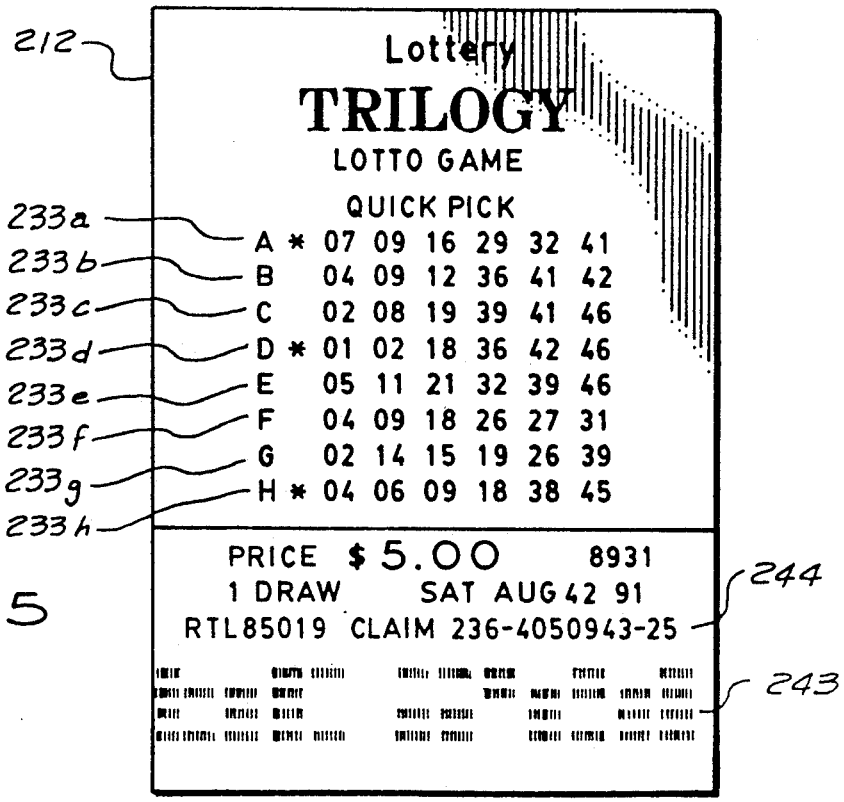
FIG. 5 is a plan view of an on-line generated jackpot lottery ticket corresponding to the instant ticket shown in FIG. 4 used in a second embodiment of the game.

Yet another embodiment of the invention is shown in FIGS. 4 and 5. In this embodiment of the game, both the instant game ticket and the jackpot drawing ticket are generated by an on-line computer. In this embodiment of the game, two on-line generated lottery tickets are generated at the same time for play of the game. These tickets 211 and 212 are associated with each other by means of a verification system. The verification means in this game can be done by computer generated bar codes 241 and 243 imprinted on each ticket. Additionally, identification numbers 242 and 244 are also printed on each ticket.

In the play of this embodiment of the game a player purchases a related set of lottery tickets comprising one or more individual plays. In this version of the game, the numbers selected for play in the jackpot drawing may be randomly generated by the computer or may be selected at the time of purchase by the player. Each instant play 223*a–h* consists of a randomly generated series of letters. For each instant play their is a corresponding jackpot play 233*a–h*. The instant-win game, the jackpot game and the bonus game operate substantially the same as described previously.

While the invention has been described with reference to the preferred embodiments thereof, those skilled in the art will understand that variations in design, detail and choice of materials for manufacture may be made and still fall within the spirit and scope of the present invention, which is intended to be limited only by the claims appended hereto.

What is claimed is:

1. A method for playing lottery games, including the following steps:

(a) providing a lottery ticket containing at least one instant-win lottery game play and at least one jackpot lottery game play said instant-win lottery game play being played with a first series of indicia imprinted on said ticket and said jackpot lottery game play being played with a second series of indicia imprinted on said lottery ticket;

(b) associating each instant-win lottery game play with a corresponding jackpot lottery game play;

(c) playing said instant-win lottery game play in combination with said jackpot lottery game play;

(d) determining whether the player has won said instant-win lottery game play by determining whether said first series of indicia matches a predetermined set of indicia;

(e) determining whether the player has won said jackpot lottery game play by determining whether said second series of indicia matches a series of indicia randomly selected by lottery officials;

(f) identifying which jackpot lottery game plays correspond to winning instant-win lottery game plays, said jackpot lottery game plays thereby becoming bonus jackpot lottery game plays;

(g) entering said bonus jackpot lottery game plays in a bonus jackpot lottery game; and (h) awarding a valuable prize to a player that has won any of said lottery game plays.

2. The method of claim 1, further including the player playing multiple lottery game plays on said lottery ticket.

3. The method of claim 1, further including providing to the player means for choosing indicia for said jackpot lottery game play.

4. The method of claim 1, further including collecting an instant-win lottery game prize prior to a jackpot lottery game drawing.

5. The method of claim 1, further including determining winning jackpot lottery game indicia through a central, random drawing.

6. The method of claim 1, further including determining winning valuable prize indicia through a central, random drawing.

7. The method of claim 1, further including providing the player with one or more chances to win valuable prizes using said bonus jackpot lottery game plays.

8. The method of claim 1, further including providing means for lottery officials to verify that said jackpot lottery game play used to win said valuable prize in said bonus jackpot lottery game corresponds to a winning instant-win lottery game play.

9. An apparatus for playing lottery-type games comprising:

(a) a game ticket having a plurality of lottery games on said game ticket, said plurality of lottery games being playable through indicia printed on said game ticket, and said plurality of lottery games being traceably connected with each other through means for correlating said lottery games printed on said ticket;

(b) means for physical separation of said plurality of lottery games on said game ticket;

(c) identification means for correlating individual game plays from one lottery game with individual game plays from other lottery games on said game ticket;

(d) means for determining the winners of said lottery games;

(e) means for playing one or more additional lottery games based upon winning one of said lottery games on said game ticket; and (f) means for identifiably connecting game plays within each of said plurality of lottery games to corresponding game plays within each remaining lottery game on said game ticket.

10. The apparatus of claim 9, further comprising at least a portion of said indicia that are covered with an opaque removable material.

11. The apparatus of claim 9, further comprising said identification means that are covered with an opaque removable material.

12. The apparatus of claim 9, wherein at least one of said plurality of lottery games is an instant-win game.

13. The apparatus of claim 9, wherein at least one of said plurality of lottery games is a jackpot game.

14. The apparatus of claim 9, wherein said means for physical separation of said plurality of lottery games is a perforation across said game ticket.

15. The apparatus of claim 9, wherein said game ticket is printed at a time of purchase.

16. The apparatus of claim 15, wherein said plurality of lottery games are each printed at the time of purchase on separate game tickets.

17. The apparatus of claim 9, further comprising a plurality of game plays within each of said plurality of lottery games.

18. A method for playing lottery games, including the following steps:

(a) providing a plurality of associated lottery tickets with at least one of said tickets containing at least one instant-win lottery game play and with at least one of said tickets containing at least one jackpot lottery game play, said instant-win lottery game play being played with a first series of indicia imprinted on one of said tickets and said jackpot lottery game play being played with a second series of indicia imprinted on one of said lottery tickets;

(b) associating said plurality of lottery tickets by providing said tickets with a means for correlating said plurality of tickets;

(c) associating each instant-win lottery game play with at least one corresponding jackpot lottery game play;

(d) playing said instant-win lottery game play in combination with said jackpot lottery game play;

(e) determining whether the player has won said instant-win lottery game play by determining whether said first series of indicia matches a predetermined set of indicia;

(f) determining whether the player has won said jackpot lottery game play by determining whether said second series of indicia matches a series of indicia randomly selected by lottery officials;

(g) identifying which jackpot lottery game plays correspond to winning instant-win lottery game plays, said jackpot lottery game plays thereby becoming bonus jackpot lottery game plays;

(h) entering said bonus jackpot lottery game plays in a bonus jackpot lottery game; and (i) awarding a valuable prize to a player that has won any of said lottery game plays.

19. The method of claim 18, further including the player playing multiple lottery game plays on said lottery ticket.

20. The method of claim 18, further including providing to the player means for choosing indicia for said jackpot lottery game play.

21. The method of claim 18, further including collecting an instant-win lottery game prize prior to a jackpot lottery game drawing.

22. The method of claim 18, further including determining winning jackpot lottery game indicia through a central, random drawing.

23. The method of claim 18, further including providing the player with one or more chances to win valuable prizes using said bonus jackpot lottery game plays.

24. The method of claim 18, further including lottery officials verifying that said jackpot lottery game play used to win said valuable prize in said bonus jackpot lottery game corresponds to a winning instant-win lottery game play.

* * * * *